US006577837B2

(12) United States Patent
Iida et al.

(10) Patent No.: US 6,577,837 B2
(45) Date of Patent: Jun. 10, 2003

(54) IMAGE FORMING METHOD AND IMAGE FORMING APPARATUS

(75) Inventors: Yoshifumi Iida, Minamiashigara (JP); Masaki Nakamura, Minamiashigara (JP); Daisuke Ishizuka, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/976,150

(22) Filed: Oct. 15, 2001

(65) Prior Publication Data

US 2002/0146258 A1 Oct. 10, 2002

(30) Foreign Application Priority Data

Oct. 19, 2000 (JP) ..... 2000-318998

(51) Int. Cl.[7] ..... G03G 13/08; G03G 15/08; G03G 15/16; G03G 15/20

(52) U.S. Cl. ..... 399/307; 399/329; 430/111.4; 430/124; 430/126

(58) Field of Search ..... 399/307, 329, 399/328, 302; 430/124, 126, 111.4, 108.1, 108.6, 108.7, 109.1

(56) References Cited

U.S. PATENT DOCUMENTS

| | | | | |
|---|---|---|---|---|
| 6,040,104 A | * | 3/2000 | Nakamura et al. | 430/111.4 X |
| 6,078,775 A | * | 6/2000 | Arai et al. | 399/302 |
| 6,096,463 A | * | 8/2000 | Hamano et al. | 430/124 X |
| 6,272,309 B1 | * | 8/2001 | Kitazawa et al. | 399/328 |
| 6,329,114 B1 | * | 12/2001 | Watanabe et al. | 430/111.4 X |
| 6,346,356 B1 | * | 2/2002 | Ohno et al. | 430/108.1 |

FOREIGN PATENT DOCUMENTS

| | | | |
|---|---|---|---|
| JP | 46-41679 | | 12/1971 |
| JP | 56-158340 | | 12/1981 |
| JP | 57-20632 | | 4/1982 |
| JP | 58-36341 | | 8/1983 |
| JP | 59-4699 | | 1/1984 |
| JP | 59-74579 | | 4/1984 |
| JP | 60-129768 | | 7/1985 |
| JP | 61-132792 | | 6/1986 |
| JP | 10-133422 | * | 5/1988 |
| JP | 64-1023 | | 1/1989 |
| JP | 64-1024 | | 1/1989 |
| JP | 64-1027 | | 1/1989 |
| JP | 3-63756 | | 10/1991 |
| JP | 3-63757 | | 10/1991 |
| JP | 3-63758 | | 10/1991 |

* cited by examiner

*Primary Examiner*—Sophia S. Chen
(74) *Attorney, Agent, or Firm*—Oliff & Berridge, PLC

(57) ABSTRACT

An image forming method has steps of transferring a toner image formed on an image bearing member onto an intermediate transfer member and simultaneously transferring and fixing the toner image on the intermediate transfer member onto a recording medium. The toner contains a binder resin and a colorant, and has a storage elastic modulus (G') of $2\times10^2$ to $6\times10^3$ Pa at a temperature at which a loss elastic modulus (G") reaches $1\times10^4$ Pa, and the simultaneous transfer and fixing is conducted using a transfer and fixing unit which has a nip between a fixing roll coated with an elastic member and a heat-resistant belt laid across support rolls, and the heat-resistant belt is urged against the fixing roll and the elastic member of the fixing roll is twisted at an exit of the nip with a pressure roll mounted inside the heat-resistant belt.

17 Claims, 1 Drawing Sheet

IMAGE FORMING METHOD AND IMAGE FORMING APPARATUS

FIELD OF THE INVENTION

The present invention relates to an image forming method in which an electrostatic latent image is developed and transferred onto an intermediate transfer member and the image is transferred and fixed onto a recording medium through heating in an electrophotographic method or an electrostatic recording method, and an image forming apparatus used in this method.

DESCRIPTION OF THE RELATED ART

In an image forming apparatus of an ordinary electrophotographic system, for example, an image forming apparatus in which an electrostatic latent image is formed on an image bearing member and developed with a dry toner to form a toner image and the toner image is then electrostatically transferred and fixed onto a recording medium to obtain the image, there arise often problems that non-uniform density occurs in the image or a toner powder is scattered to impair the resolution of the image or the dot reproducibility. The non-uniform density or the toner scattering mainly occurs while the toner image on the image bearing member is electrostatically transferred onto the recording medium.

In the electrostatic transfer method, a toner transfer efficiency is increased in proportion to an intensity of an electric field to be applied to the toner layer. However, when the intensity of the electric field becomes higher than a certain degree, so-called Paschen discharge occurs to decrease the transfer efficiency. That is, the transfer efficiency shows a peak value in a certain intensity of the electric field. Generally, the peak value of the transfer efficiency, in many cases, does not reach 100%, and remains approximately 95% at the highest.

The transfer efficiency of the toner layer thus depends on the intensity of the electric field. Accordingly, as the intensity of the electric field is changed owing to a non-uniform thickness of the toner layer, or an uneven surface or non-uniform electric properties of a recording medium such as paper, the transfer efficiency is also changed. When the toner image formed on the recording medium is monochromic and a layer is thin, the intensity of the electric field is mainly changed owing to the uneven surface or the non-uniform electric properties of the recording medium, with the result that the image mottle occurs. When monochromic toner images formed independently on the image bearing member are overlaid and transferred onto the recording medium to form a color image, the image mottle also occurs owing to the uneven surface or the non-uniform electric properties of the recording medium. In the electrostatic transfer method, a difference in transfer efficiency by the change in a thickness of a layer between a portion of a high layer thickness formed by overlaying and transferring plural toner images and a portion of a low layer thickness formed by transferring a monochromic toner image is small, but the transfer efficiency is greatly changed and the image mottle tends to occur owing to the uneven surface or the non-uniform electric properties of the recording medium.

Meanwhile, in a so-called color image forming apparatus of an intermediate transfer system in which plural toner images formed independently on an image bearing member are electrostatically transferred primarily onto an intermediate transfer member having a less uneven surface with less non-uniform electric properties to be overlaid thereon in order and the multicolor toner image formed on the intermediate transfer member is secondarily transferred onto a recording medium, the transfer efficiency is less changed, so that an image with less image mottle can be obtained.

For transferring a toner image onto a recording medium such as paper electrostatically uniformly, it is required to apply a fixed electric field. With respect to a multicolor toner image formed on an intermediate transfer member, there is an area in which a toner image with plural layers, such as three or more layers is formed, while there is an area in which no toner image layer is formed. Accordingly, it is difficult to apply a fixed electric field to the toner image of which the layer thickness varies greatly, and the intensity of the electric field tends to be non-uniform. Consequently, in the secondary transfer by the electrostatic transfer method, not all of the multicolor toner images formed on the intermediate transfer member are transferred onto the recording medium, and a part thereof remain on the intermediate transfer member. The amount of the toner remaining on the intermediate transfer member varies depending on the thickness of the toner layer on the intermediate transfer member. As a result, the color balance of the color images obtained on the recording medium is lost, and desired color images are hardly obtained. Besides, due to the uneven surface of the recording medium, the recording medium and the intermediate transfer member are not completely adhered. The transfer electric field becomes non-uniform owing to a non-uniform gap generated therebetween, or the transfer efficiency is decreased with a Coulomb repulsion force of toners to decrease the image quality.

In order to solve these problems, Japanese Patent Publication No. 41679/1971 discloses an image forming method which has steps of adhesively transferring a toner image formed on an image bearing member onto a surface of an elastic intermediate transfer member, then heating a recording medium fed between the intermediate transfer member and a heating roller using the heating roller, and fusing the toner image on the intermediate transfer member to thermally transfer the toner image on the transfer member onto the recording medium. Further, Japanese Patent Publication Nos. 1024/1989 and 1027/1989 disclose a method in which an endless belt-like intermediate transfer member and a recording medium superposed with a toner image transferred onto the intermediate transfer member therebetween are urged with a heating roll and a pressure roll to transfer and fix the toner image on the intermediate transfer member onto a recording medium. Still further, Japanese Patent Publication Nos. 20632/1982, 36341/1983 and 1023/1989 disclose a method which has steps of heating a toner image transferred onto an endless belt-like intermediate transfer member to a temperature above a melting point of a toner, and then urging the intermediate transfer member against a recording medium to transfer and fix the toner image on the intermediate transfer member onto the recording medium, wherein after the intermediate transfer member is urged against the recording medium, the intermediate transfer member and the recording medium are circulated and moved while being contacted with each other for a long period of time, and heat transfer from the intermediate transfer member to the recording medium is satisfactorily conducted in this contact state to surely transfer and fix the toner image on the intermediate transfer medium onto the recording medium.

In these non-electrostatic transfer methods, the troubles caused by the non-uniformity of the electric field which are found in the foregoing electrostatic transfer method do not occur, so that a high-quality image with a good color balance can be obtained in a color image with a high transfer efficiency of a toner image and a high sharpness. However, in the methods disclosed in Japanese Patent Publication Nos. 41679/1989, 1024/1989 and 1027/1989, there are problems that since a pressure roll mounted on the reverse side of the recording medium is not provided with a heating unit, the recording medium takes out a large amount of heat so that the toner of the toner image in contact with the recording medium is hardly fused on the recording medium and insufficient fixing tends to occur in the image formation at a high speed in particular.

Furthermore, in the methods disclosed in Japanese Patent Publication Nos. 20632/1982, 36341/1983 and 1023/1989, there are problems that while the intermediate transfer member and the recording medium are moved in contact with each other for a long period of time, they come sometimes out of contact with each other, and therefore image disorder occurs or a pressure applied to the intermediate transfer member and the recording medium becomes non-uniform to cause image disarray.

Besides these methods, Japanese Patent Publication Nos. 63756/1991, 63757/1991 and 63758/1991 disclose a transfer and fixing method wherein in an image forming apparatus in which an intermediate transfer member carrying a toner image is urged against a recording medium with a pair of pressure rolls to transfer and fix the toner image on the intermediate transfer member onto the recording medium, a heater for preheating the recording medium is, separately from the pair of pressure rolls, mounted on an upstream side of a transfer and fixing zone to enable the high-speed fixing. Among the transfer-fixing methods using the heater for preheating as disclosed in these three documents, the method disclosed in Japanese Patent Publication No. 63756/1991 is a method in which the toner image on the intermediate transfer member is heated at a temperature lower than the fusing temperature of the toner, the pressure rolls heated at a temperature higher than the fusing temperature of the toner is urged against the intermediate transfer member, and the recording medium heated at the temperature higher than the fusing temperature of the toner is fed to the urged portion to transfer and fix the toner image onto the recording medium.

The method disclosed in Japanese Patent Publication No. 63757/1991 is, unlike the method of Japanese Patent Publication No. 63756/1991, a method in which the toner image on the intermediate transfer member is heated to a temperature lower than the fusing temperature of the toner, the pressure rolls heated at a temperature lower than the fusing temperature of the toner is urged against the intermediate transfer member, and the recording medium heated to a temperature higher than the fusing temperature of the toner is fed to the urged portion to transfer and fix the toner image onto the recording medium. Further, the method disclosed in Japanese Patent Publication No. 63758/1991 is, unlike the methods of Japanese Patent Publication Nos. 63756/1991 and 63757/1991, a method in which the toner image on the intermediate transfer member is heated to a temperature lower than the fusing temperature of the toner, the pressure rolls heated to a temperature higher than the fusing temperature of the toner are urged against the intermediate transfer member, and the recording medium heated at a temperature lower than the fusing temperature of the toner is fed to the urged portion to transfer and fix the toner image onto the recording medium.

In the transfer and fixing method using the heater for preheating as disclosed in these three documents, the excessive heating of the pressure rolls can be controlled to improve the thermal efficiency. However, it is difficult to completely eliminate the non-uniform melting of the toner image.

A fixing method and a fixing unit having a pair of pressure members and a pressure member heater that heats the pressure members as employed in an image forming apparatus are described in, for example, Japanese Patent Publication No. 4699/1984 and Japanese Patent Laid-Open Nos. 74579/1984 and 129768/1985. In the fixing method and the fixing unit, a main part has a rotatable heat-fixing roll having a heating source therein, a rotatable pressure roll mounted by being urged against the heat-fixing roll and a release agent feeding unit mounted on the heat-fixing roll to feed a release agent for preventing offset to the outer periphery of the heat-fixing roll, and a transfer paper that carries an unfixed toner image is passed between the heat-fixing roll and the pressure roll to fix the toner image. The heat-fixing roll includes a substrate roll having a heating source therein, an inner elastic layer formed on the substrate roll and an outer elastic layer mounted on the inner elastic layer and formed of an elastic material having an affinity for the release agent for preventing offset and an abrasion resistance, such as a fluororubber. The heat-fixing roll is brought into contact with the transfer paper by the elasticity of the inner elastic layer with an appropriate pressure and an appropriate contact width, and the offset phenomenon is prevented with the action of the release agent fed to the outer elastic layer.

Moreover, to meet the high speed, a method using a belt is proposed as described in Japanese Patent Laid-Open No. 132972/1986 (this method is hereinafter referred to as a belt nip method). In the belt nip method, using a fixing unit having an endless belt rotatably tensioned with plural support rolls and a heat-fixing roll that forms a belt nip in contact with the endless belt, a paper having an unfixed toner image formed thereon is passed through a belt nip between the heat-fixing roll and the endless belt to fix the image with the pressure and the heat energy in the belt nip. After passed through the belt nip, the paper is peeled off with a peel nail, and discharged outside the fixing unit. In this construction, the greater width of the belt nip between the endless belt and the heat-fixing roll can easily be secured than in the ordinary roll nip method to cope with the high speed. Further, at the same fixing speed, the heat-fixing roll in the belt nip method can be downsized in comparison with that in the roll nip method.

Nevertheless, a so-called offset phenomenon tends to occur that when the surface of the heat-fixing roll is contacted with the toner surface, the toner fused is adhered to the surface of the heat-fixing roll and migrates to a transfer medium such as paper to be fed later. In order to prevent the offset phenomenon, the surface of the heat-fixing roll is coated with a material having a good releasability from the toner fused, such as a silicone rubber or a fluororesin or with a liquid release agent such as silicone oil.

On the other hand, in recent years, an electrophotographic process has found wide acceptance in not only copying machines but also printers because of the development of appliances or the improvement of communication network in society of information technology, and downsizing, weight reduction, high speed and reliability of apparatus used have been increasingly required strictly. Especially in case of color electrophotography, an image formed is required to have a high quality and a high level of color formation. For obtaining a high-quality image with a high level of color formation, it is required, in view of a light transmission and a gloss, that a toner is satisfactorily fused and a surface of an image after fixed is smooth. To this end, a fixing step in the electrophotographic process is especially important.

As a contact-type fixing method which has been often used, a method using a heat and a pressure in the fixing (hereinafter referred to as a heat-pressing method) is generally employed. In case of the heat-pressing method, a surface of a fixing member and a toner image on a transfer medium are contacted under pressure. Accordingly, a thermal efficiency is quite good, and the fixing can quickly be conducted. This method is quite effective in a high-speed electrophotographic copying machine.

However, since the surface of the fixing member is contacted with the toner image under pressure in a heat-fused state in the heat-pressing method, an offset or wrapping phenomenon in which a part of the toner image migrates to the surface of the fixing member by being adhered thereto is liable to occur. In particular, in the color toner fixing in which plural color toners have to be fused and mixed, it is required, in comparison with the monochromic toner fixing, that sufficient heat and pressure are applied to the toner to make the toner flowable and that a toner layer in a fused state which is thick with plural colors overlaid is released without an offset or wrapping phenomenon. Thus, the releasing in the fixing of the color toner is more difficult than that in the fixing of the monochromic toner.

With respect to a simple method for preventing the adhesion of the toner to the surface of the fixing member, the surface of the fixing member is coated with silicon oil as a liquid for preventing offset. However, the use of oil involves a problem of adhesion of oil to the transfer medium and the image after the fixing. Further, it is problematic in that a tank for storing oil is required in the fixing unit which makes it difficult to downsize the fixing unit and that supply of oil is troublesome to restrict the cost reduction.

Ordinarily, the amount of oil coated on a general transfer medium in the color fixing is as large as approximately $8.0\times10^{-2}$ mg/cm$^2$, while oil is not used at all in monochromic printers or even when oil is used, its amount is less than $8.0\times10^{-4}$ mg/cm$^2$ which is 1/100 of the amount of oil coated in the color fixing. Thus, the foregoing defect is not given in practice. Thus, it has been earnestly demanded that even the color fixing is enabled with the same amount of oil as in monochromic printers. Accordingly, various methods have been proposed in which the releasability of the toner is improved not by a fixing unit but by modification of a toner resin or a wax.

For example, Japanese Patent Laid-Open No. 158340/1981 discloses a monochromic toner that exhibits an excellent oilless fixing suitability by effects of a resin containing a low-molecular component and a high-molecular component and thus having a wide molecular weight distribution and a wax. The resin for the monochromic toner is adapted to endure a peel strength exerted on a toner layer in an interface of a fixing unit, namely to prevent offset with an elasticity of a rubber given by entanglement of the high-molecular component diluted with the low-molecular component.

However, when this technique is developed in the fixing of a color image, there are some problems. That is, (1) since the binder resin having the rubber elasticity given by entanglement of the high-molecular component is used, a gloss level of an image fixed is lowered to decrease color formation of a color image. (2) The binder resin is elastic but is itself soft and liable to deformation because it contains the low-molecular component in the molecule. Accordingly, when the number in toner layer is increased and 3 or 4 layers are used as in a color image, the binder resin tends to cause wrapping of the toner layers around a fixing unit in deformation by peeling to decrease a peelability. (3) In case of a color image with multiple toner layers, a wax is bled out between toner layers having different colors, with the result that the peeling of the toner layers, namely the offset tends to occur. Thus, the effect of preventing the offset is not so obtained as in the fixing of the monochromic image.

In the color toner as well, various fixing units such as a fixing unit using a high-molecular component and a fixing unit using a wax have been proposed. It is however difficult to overcome the foregoing problems. Even though a releasability is somewhat improved, the improvement with no practical problem by using oil in the same amount as in the fixing of the monochromic toner has not yet been attained.

Moreover, when the wrapping of the toner layer around the fixing unit by the adhesion of the toner can be prevented, a hot offset resistance is obtained by the viscoelasticity properties though somewhat controlling the color formation. However, in the resin of which the molecular weight distribution is widened using the mere combination of the high-molecular component and the low-molecular component, no sufficient releasability is obtained, and the large amount of oil is therefore needed for preventing the wrapping of the toner layer as stated above. Further, a styrene-acrylic resin tends to cause wrapping phenomenon around a fixing unit because of a low elastic modulus of a rubber due to a resin composition, even though a molecular weight is increased. Thus, no sufficient peelability is provided.

In addition, a fixing unit using a high-molecular component or a toner with a wax is problematic in that a gloss level is decreased. Especially when a ratio of a high-molecular component is increased, a gloss level is extremely decreased. This cannot be controlled by increasing a fixing temperature, and it is ascribable to the material.

In the mechanism of heating the intermediate transfer member and the belt nip method, not all of toners can be used in view of controlling the gloss level. The heating of the intermediate transfer member is advantageous in that a high gloss level can be obtained regardless of a type of a toner material. However, when the intermediate transfer member is preheated to decrease image unevenness and obtain a transfer efficiency, an image tends to be disarrayed on the intermediate transfer member heated in case of, for example, a toner using a resin having a low glass transition point (Tg). Further, in case of a toner using a resin containing a large amount of a high-molecular component, there is a tendency that an excessive amount of electricity is required to fuse the toner. In the pressure fixing area also, a gloss level which is an important factor of an image quality is restricted by the type of the toner material in the belt nip method alone. For example, when a low-molecular resin is used, a high gloss level is provided. Meanwhile, when a high-molecular resin is used, a low gloss level is provided. It is thus difficult to control the gloss level.

SUMMARY OF THE INVENTION

The invention has been made in view of the foregoing circumstances, and provides an image forming method and an image forming apparatus. That is, the invention provides, upon solving the problems in the related art, an image forming method in which without substantially feeding a release agent, neither image disarray in image transfer nor non-uniform melting of a toner occurs and a gloss level of an image can be controlled, and an image forming apparatus used in this method.

According to an aspect of the invention, an image forming method has steps of: transferring a toner image formed on an image bearing member onto an intermediate transfer member; and simultaneously transferring and fixing the toner image on the intermediate transfer member onto a recording medium using a transfer and fixing unit. The toner forming the toner image contains a binder resin and a colorant, and the toner has a storage elastic modulus (G') of $2\times10^2$ to $6\times10^3$ Pa at a temperature at which a loss elastic modulus (G") of the toner reaches $1\times10^4$ Pa, and the transfer and fixing unit has a nip between a fixing roll coated with an elastic member and a heat-resistant belt laid across in a tensioned condition with support rolls, and the heat-resistant belt is urged against the fixing roll and the elastic member of the fixing roll is twisted at an exit of the nip with a pressure roll mounted inside the heat-resistant belt through the heat-resistant belt.

In the binder resin of the toner, a number average molecular weight (Mn) is in the range of 2,500 to 20,000, a weight average molecular weight (Mw) is in the range of 9,000 and 90,000, a softening point (Tm) is in the range of 60° C. to 120° C., and a glass transition point (Tg) is in the range of 45° C. to 70° C.

According to another aspect of the invention, an image forming apparatus has: a transfer unit that transfers a toner image formed on an image bearing member onto an intermediate transfer member; and a simultaneous transfer and fixing unit that transfers and fixes the toner image on the intermediate transfer member onto a recording medium. The toner forming the toner image contains a binder resin and a colorant, and the toner has a storage elastic modulus (G') of $2\times10^2$ to $6\times10^3$ Pa at a temperature at which a loss elastic modulus (G") of the toner reaches $1\times10^4$ Pa, and the transfer and fixing unit has a nip between a fixing roll coated with an elastic member and a heat-resistant belt laid across in a tensioned condition with support rolls, and the heat-resistant belt is urged against the fixing roll and the elastic member of the fixing roll is twisted at an exit of the nip with a pressure roll mounted inside the heat-resistant belt through the heat-resistant belt.

BRIEF DESCRIPTION OF THE DRAWINGS

Preferred embodiments of the invention will be described in detail based on the following figures, wherein.

Figure 1:
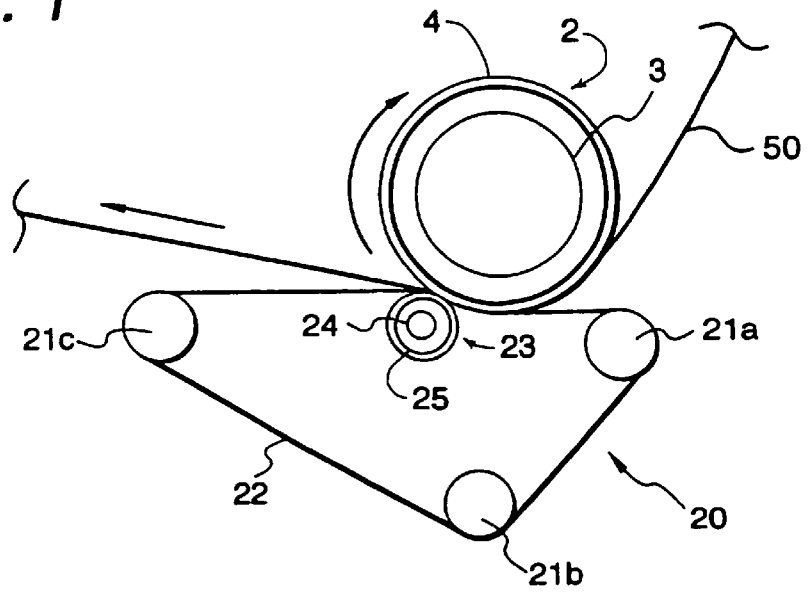
FIG. 1 is a schematic view showing an example of a fixing unit which can be used in the simultaneous transfer and fixing step in an image forming method of the invention.

In the drawings, 1*a*, 1*b*, 1*c*, 1*d* are photoreceptors (image bearing members); 2 a fixing roll; 3 a halogen lamp; 5*a*, 5*b*, 5*c*, 5*d* support rolls; 9 a heater; 10*a*, 10*b*, 10*c*, 10*d* chargers; 11*a*, 11*b*, 11*c*, lid developing units; 12*a*, 12*b*, 12*c*, 12*d* transfer units; 20 a belt nip unit; 21*a*, 21*b*, 21*c* support rolls; 22 a heat-resistant belt; 23*a* pressure roll; 24 a halogen lamp; 40 a cooling unit; 50 an intermediate transfer member; and 60 paper (recording medium).

BEST MODE FOR CARRYING OUT THE INVENTION

The invention is described in detail below.

The image forming method of the invention includes at least the transfer step and the simultaneous transfer and fixing step, and further includes the other steps as required.

The image forming method of the invention is characterized in that a fixing unit of a belt nip method specified in the invention is combined with a toner having specific viscoelasticity characteristics, whereby the aim of the invention can be attained for the first time.

To begin with, the toner used in the image forming method of the invention is described in detail below.

The toner contains at least a binder resin and a colorant, and further contains other components as required.

Moreover, in the toner, it is required that at a temperature at which a loss elastic modulus (G") of the toner reaches $1\times10^4$ Pa, a storage elastic modulus (G') of the toner is in the range of $2\times10^2$ Pa to $6\times10^3$ Pa. When the storage elastic modulus (G') is less than $2\times10^2$ Pa in transferring the toner image onto the intermediate transfer member and then heating the same, the melting proceeds in the heating which makes it impossible to maintain the original image and provides melting non-uniformity. This occurs notably in thin lines, leading to a serious image defect. Further, when the storage elastic modulus (G') is more than $6\times10^3$ Pa, an elasticity of the toner is increased to cause fixing insufficiency in transferring and fixing the toner onto the recording medium. Especially, this is notably observed in an image obtained by overlaying toners of second and third colors.

In the invention, at the temperature at which the loss elastic modulus (G") of the toner reaches $1\times10^4$ Pa, the storage elastic modulus (G') of the toner is preferably $2\times10^2$ Pa to $6\times10^3$ Pa, more preferably $6\times10^2$ Pa to $4\times10^3$ Pa.

With respect to the toner used in the invention, the following method is mentioned to control the storage elastic modulus (G') of the toner in the range of $2\times10^2$ Pa to $6\times10^3$ Pa at the temperature at which the loss elastic modulus (G") of the toner reaches $1\times10^4$ Pa.

That is, in case of the same binder resin material, the storage elastic modulus (G') can be controlled by controlling Mw. In the same material (for example, a polyester), the storage elastic modulus (G') can be increased by increasing Mw. Further, it can be controlled by the type or the molecular weight distribution of the binder resin material (in the distribution in which an amount of a high-molecular component is large, the storage elastic modulus (G') is increased).

The viscoelasticity characteristics of the toner used in the invention are measured as follows. The storage elastic modulus (G') of the toner at the temperature at which the loss elastic modulus (G") of the toner reaches $1\times10^4$ Pa is measured through a rheometer "RDA2" (RHIOS system ver. 4.3) of Rheometrics using parallel plates 8 mm in diameter at a plate interval of 4 mm with a frequency of 1 rad/sec, a rate of rise of 1° C./min and a measurement temperature range of 40° C. to 150° C. by automatic distortion control of 20% at the highest.

The volume average particle diameter ($D_{50}$) of the toner is preferably 2 $\mu$m to 9 $\mu$m, more preferably 3 $\mu$m to 7 $\mu$m. When the volume average particle diameter is less than 2 $\mu$m, not only is the fluidity of the toner decreased, but also a satisfactory chargeability is hardly imparted from a carrier. Consequently, there is a tendency that fogging occurs in a background area or a density reproducibility is decreased. Meanwhile, when it exceeds 9 $\mu$m, a reproducibility of fine dots, a gradation and a granularity are less improved.

The volume average particle diameter of the toner is measured using Multisizer II manufactured by Coulter.

The toner contains the binder resin and the colorant as main components.

Examples of the binder resin include homopolymers or copolymers of monoolefins such as ethylene, propylene, butylene and isoprene, vinyl esters such as vinyl acetate, vinyl propionate, vinyl benzoate and vinyl butyrate, a-methylene aliphatic monocarboxylic acid esters such as methyl acrylate, phenyl acrylate, octyl acrylate, methyl methacrylate, ethyl methacrylate, butyl methacrylate and dodecyl methacrylate, vinyl ethers such as vinylmethyl ether, vinylethyl ether and vinylbutyl ether, and vinyl ketones such as vinyl methyl ketone, vinyl hexyl ketone and vinyl isopropenyl ketone. Of these, typical examples of the binder resin include a styrene-alkyl acrylate copolymer, a styrene-butadiene copolymer, a styrene-maleic anhydride copolymer, polystyrene and polypropylene. Further, a polyester, a polyurethane, an epoxy resin, a silicone resin, a polyamide and a modified resin are listed.

In the invention, the number average molecular weight (Mn) of the binder resin is preferably 2,500 to 20,000, more preferably 4,000 to 15,000. When Mn is less than 2,500, the intensity of the image after fixed might be little obtained or non-uniform melting of a thin line might occur in the fixing. Meanwhile, when Mn exceeds 20,000, the minimum fixing temperature might be increased.

The weight average molecular weight (Mw) of the binder resin is preferably 9,000 to 90,000, more preferably 12,000 to 60,000. When Mw is less than 9,000, the intensity of the image after fixed might be, as in Mn, little obtained or non-uniform melting of a thin line might occur in the fixing. Meanwhile, when Mw exceeds 90,000, the minimum fixing temperature might be increased so that pulverization is hardly conducted in the production of the toner (especially a hot pulverization method).

In the invention, the softening point (Tm) of the binder resin is preferably 60° C. to 120° C., more preferably 80° C. to 100° C. When Tm is less than 60° C., the toner sometimes tends to be blocked with heat. Meanwhile, when Tm exceeds 120° C., the fixing temperature might be increased.

The glass transition point (Tg) of the binder resin is preferably 45° C. to 70° C., more preferably 50° C. to 60° C. When Tg is less than 45° C., the toner sometimes tends to be blocked with heat as in Mn. Meanwhile, when Tg exceeds 70° C., the fixing temperature might also be increased as in Mn.

In the invention, the molecular weights (Mn, Mw) of the binder resin are measured using GPC, HLC 8120GPC manufactured by Tosoh Corp. Further, the softening point (Tm) is measured using a flow tester, CFT 500C manufactured by Shimadzu Corporation. The glass transition point (Tg) is measured using DSC, DSC 60 manufactured by Shimadzu Corporation.

The colorant is not particularly limited. Examples of the colorant include carbon black, aniline blue, chalcoyl blue, chrome yellow, ultramarine blue, du Pont oil red, quinoline yellow, methylene blue chloride, phthalocyanine blue, malachite green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C. 1. Pigment Yellow 17, C.I. Pigment Blue 15:1 and C.I. Pigment Blue 15:3.

The toner can contain a charge control agent as required. When the charge control agent is used in a color toner in particular, a colorless or light-colored charge control agent that does not influence the color is preferable. As the charge control agent, known charge control agents can be used. Preferable are an azo-based metal complex and a metal complex or a metal salt of salicylic acid or alkylsalicylic acid. The toner can further contain other known components, for example, an offset preventing agent such as low-molecular propylene, low-molecular polyethylene or a wax.

When the toner is finely divided, there arise the following problems. That is, (1) the toner tends to be agglomerated because an adhesion between the toner particles is increased. (2) A charge amount is increased owing to frictional charging. (3) Since a rate of contact with a carrier is increased, the carrier tends to be contaminated and deteriorated. Accordingly, inorganic oxide fine particles having an added value of an ability to impart a fluidity or a charge controllability are recently added effectively to the toner. Among others, a BET specific surface area has to be in the range of 40 to 250 $m^2/g$, and it is preferably in the range of 80 to 200 $m^2/g$. When the BET specific surface area of the inorganic oxide fine particles to be added is larger than 250 $m^2/g$, the fluidity is improved, but the adhesion to the toner is hardly controlled, and the particles tend to be embedded in the surface of the toner, which leads to deterioration of the toner. When the specific surface area is less than 40 $m^2/g$, not only is the ability to impart the fluidity insufficient, but also filming or damage is induced in a surface of a photoreceptor. When the particles are used in a color toner, a transparency of an OHP image might be decreased.

Examples of the inorganic oxide fine particles added to the toner can include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO{\cdot}SiO_2$, $K_2O{\cdot}(TiO_2)_n$, $Al_2O_3{\cdot}2SiO_2$, $CaCO_3$, $MgCO_3$, $BaSO_4$ and $MgSO_4$. Of these, silica fine particles and titania fine particles are preferable. It is advisable that the surfaces of the inorganic oxide fine particles are previously subjected to hydrophobic treatment. This hydrophobic treatment is more effective for improvement of a fluidity of a toner powder, an environmental dependence of charge and a resistance to carrier impaction.

The hydrophobic treatment can be conducted by dipping the inorganic oxide fine particles in a hydrophobic treatment agent. The hydrophobic treatment agent is not particularly limited. Examples thereof include a silane coupling agent, silicone oil, a titanate-based coupling agent and an aluminum-based coupling agent. These may be used either singly or in combination. Of these, a silane coupling agent is preferable.

Examples of the silane coupling agent can include chlorosilanes, alkoxysilanes, silazanes and special silylation agents. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane.

The amount of the hydrophobic treatment agent varies with the type of the inorganic oxide fine particles, and cannot particularly be specified. However, it is usually 5 to 50 parts by weight per 100 parts by weight of the inorganic oxide fine particles.

In the invention, the development is not particularly limited. However, two-component development is preferable. A carrier is not particularly limited so long as the foregoing conditions are satisfied. Examples of the core of the carrier include magnetic metals such as iron, steel, nickel and cobalt, alloys of these metals and manganese, chromium and rare earth metals, and magnetic oxides such as ferrite and magnetite. In view of the core surface property and the core resistance, ferrite is preferable. Alloys with manganese, lithium, strontium and magnesium are especially preferable.

In the carrier used in the invention, the surface of the core is preferably coated with a resin. The resin is not particularly limited so long as it can be used as a matrix resin. It can be selected, as required, according to the purpose. Examples thereof include resins known per se, for example, polyolefin resins such as polyethylene and polypropylene; polyvinyl resins and polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone; a vinyl chloride-vinyl acetate copolymer; a styrene-acrylic acid copolymer; straight silicone resins having an organosiloxane bond or modified products thereof; fluororesins such as polytetrafluoroethylene, polyvinyl fluoride, polyvinylidene fluoride and polychlorotrifluoroethylene; silicone resins; polyesters; polyurethanes; polycarbonates; phenol resins; amino resins such as a urea-formaldehyde resin, a melamine resin, a benzoguanamine resin, a urea resin and a polyamide resin; and epoxy resins. These may be used either singly or in combination. In the invention, among these resins, at least fluororesins and/or silicone resins are preferably used. The use of at least fluororesins and/or silicone resins as the foregoing resin is quite advantageous in that the carrier impaction with the toner or an external additive can be prevented.

The film made of the resin is formed by dispersing at least resin particles and/or conductive particles in the resin.

The resin particles include, for example, thermoplastic resin particles and thermosetting resin particles. Of these, thermosetting resin particles are preferable because the hardness can be increased relatively easily. Nitrogen-containing resin particles are preferable in view of imparting a negative chargeability to a toner. These resin particles may be used either singly or in combination.

The average particle diameter of the resin particles is preferably 0.1 $\mu$m to 2 $\mu$m, more preferably 0.2 $\mu$m to 1 $\mu$m. When the average particle diameter of the resin particles is less than 0.1 $\mu$m, a dispersibility of the resin particles in the film is poor. Meanwhile, when it exceeds 2 $\mu$m, the resin particles tend to drop from the film, and the inherent effect is sometimes not exhibited.

Examples of the conductive particles include particles of metals such as gold, silver and copper, carbon black particles, semiconductive particles of oxides such as titanium oxide and zinc oxide, and particles obtained by coating a surface of a titanium oxide, zinc oxide, barium sulfate, aluminum borate or potassium titanate powder with tin oxide, carbon black or a metal.

These may be used either singly or in combination. Of these, carbon black particles are preferable because a production stability, costs and a conductivity are good. The type of carbon black is not particularly limited. Carbon black having a DBP absorption amount of about 50 to 250 ml/100 g is preferable because a production stability is excellent.

A method for forming the film is not particularly limited. For example, a method using a film-forming solution obtained by incorporating the resin particles such as the crosslinked resin particles and/or the conductive particles and the styrene-acrylic resin, the fluororesin or the silicone resin as a matrix resin in a solvent is mentioned.

Specific examples thereof include a dipping method in which the carrier core is dipped in the film-forming solution, a spray method in which the film-forming solution is sprayed to the surface of the carrier core, and a kneader coater method in which the carrier core floating with flowing air is mixed with the film-forming solution to remove the solvent. Of these, a kneader coater method is preferable in the invention.

The solvent used in the film-forming solution is not particularly limited so long as it can dissolve the resin as the matrix resin, and it can be selected from solvents known per se. Examples of the solvent include aromatic hydrocarbons such as toluene and xylene, ketones such as acetone and methyl ethyl ketone, and ethers such as tetrahydrofuran and dioxane.

When the resin particles are dispersed in the film, the resin particles and the matrix resin particles are uniformly dispersed in its thickness direction and the tangential direction of the carrier surface. Accordingly, even when the carrier is used for a long period of time and the film is worn out, the same surface condition as before use can be maintained, and the toner can maintain a good chargeability over a long period of time. Further, when the conductive particles are dispersed in the film, the conductive particles and the matrix resin are uniformly dispersed in its thickness direction and the tangential direction of the carrier surface. Accordingly, even when the carrier is used for a long period of time and the film is worn out, the same surface condition as before use can be maintained, and the carrier deterioration can be prevented over a long period of time. When the resin particles and the conductive particles are dispersed in the film, the above-mentioned effects can be brought forth at the same time.

Next, the transfer and fixing unit used in the simultaneous transfer and fixing step is described.

FIG. 1 is a schematic view showing an example of a fixing unit which can be used in the simultaneous transfer and fixing step in the image forming method of the invention.

This transfer and fixing unit is a transfer and fixing unit of a belt nip method in which a fixing roll 2 and a belt nip unit 20 are mounted opposite to each other through an intermediate transfer member 50.

The belt nip unit 20 is provided with a heat-resistant belt 22 tensioned with support rolls 21*a*, 21*b*, 21*c*, and a pressure roll 23 is mounted inside the heat-resistant belt 22. The pressure roll 23 is provided thereinside with a halogen lamp 24 to heat the surface of the pressure roll 23. A heating unit other than the halogen lamp may be disposed inside the pressure roll 23, or it is also possible that not any heating unit is disposed in the pressure roll 23.

The surface of the fixing roll 2 is coated with an elastic member 4, and the fixing roll 2 is provided thereinside with a halogen lamp 3 to heat the surface of the fixing roll 2. A heating unit other than the halogen lamp may be disposed inside the fixing roll 2, or it is also possible that not any heating unit is disposed therein.

Figure 2:
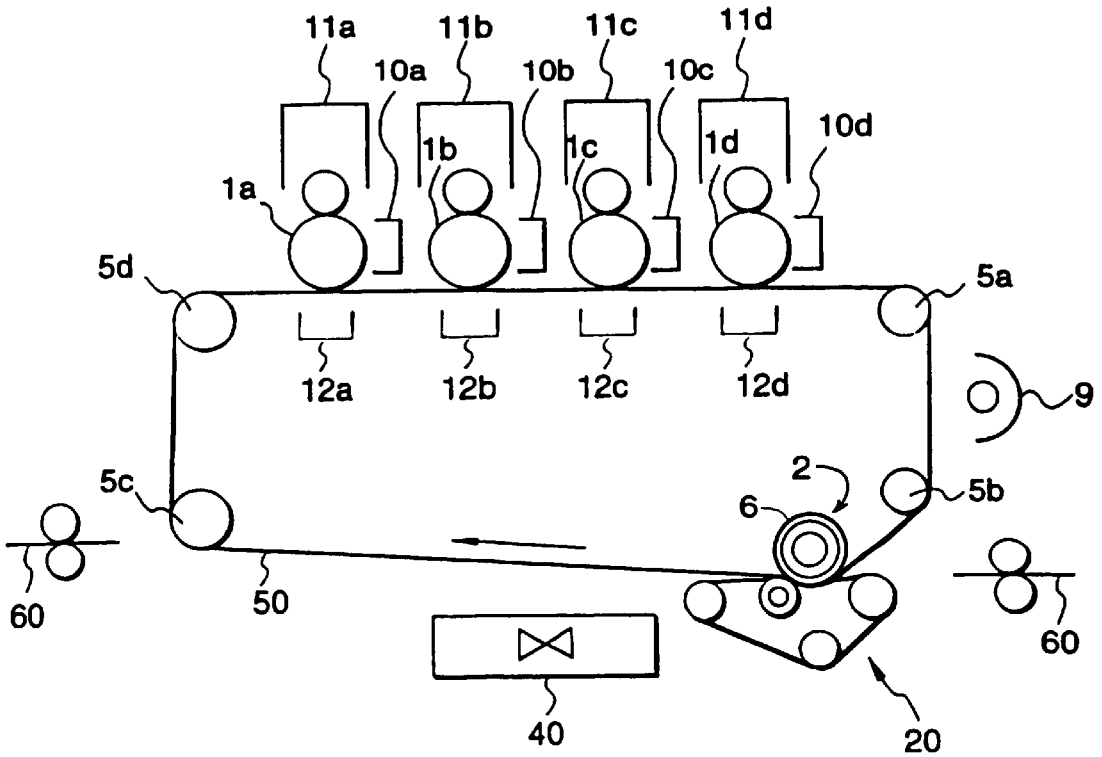
FIG. 2 is a schematic view showing an example of an image forming apparatus which can be used in the image forming method of the invention.

In the transfer and fixing unit shown in FIG. 2, for forming the nip between the fixing roll 2 and the heat-resistant belt 22 tensioned with the support rolls 21*a*, 21*b*, 21*c*, the heat-resistant belt 22 is urged against the fixing roll 2, and the elastic member of the fixing roll 2 is twisted at the exist of the nip with the pressure roll 23 mounted inside the heat-resistant belt 22 through the heat-resistant belt 22.

A metal roll having a heat-resistant elastic layer 6 thereon can be used as the fixing roll 2 and the pressure roll 23. As the metal roll, for example, having a heat-resistant elastic layer 25 and a hollow roll of aluminum, iron or copper is mentioned. Examples of the component constituting the heat-resistant elastic layer contains a component selected from a silicone rubber, a fluororubber, a fluorine latex and a fluororesin. The thickness of the heat-resistant elastic layer can be selected, as required, according to the purpose.

Examples of the material of the heat-resistant belt 22 include a polyimide film and a stainless steel belt. However, these are not critical.

In the image forming method of the invention, the gloss level of the image can be controlled by changing the pressure of the pressure roll 23 mounted inside the heat-resistant belt 22 at the exit of the nip. This is conducted by changing the position in which to peel off the recording medium from the exit of the nip. When a high gloss level is required, the nip pressure is decreased, and a distance in which to peel off the recording medium from the exit of the nip is rendered long (that is, the time for contact with the fixing member is prolonged). On the contrary, when a low gloss level is required, the nip pressure is increased, and a distance in which to peel off the recording medium from the exit of the nip is rendered short (that is, a time for contact with the fixing member is shortened). In this manner, the time for contact with the fixing member is controlled to control the smoothness of the image surface, whereby the gloss level can be changed. Accordingly, the nip pressure or the nip width can be selected, as required, according to the desired gloss level.

The image forming method of the invention is advantageous in that a wide-ranging gloss level of about 10 to 80 is provided and the gloss level ranges widely from a low gloss level to a high gloss level. The gloss level can be measured using GM26D manufactured by Murakami Color Research Laboratory.

One embodiment of the image forming method of the invention is described below by referring to the drawing. FIG. 2 is a schematic view showing an example of an image forming apparatus which can be used in the image forming method of the invention.

In the image forming method shown in FIG. 2, photoreceptors (image bearing members) 1*a*, 1*b*, 1*c*, 1*d* are mounted on an outer periphery of an intermediate transfer member 50. Chargers 10*a*, 10*b*, 10*c*, 10*d* and developing units 11*a*, 11*b*, 11*c*, 11*d* containing black, yellow, magenta and cyan toners are mounted around the photoreceptors 1*a*, 1 *b*, 1*c*, 1*d* respectively. Transfer units 12*a*, 12*b*, 12*c*, 12*d* are mounted opposite to the photoreceptors 11*a*, 11*b*, 11*c*, 11*d* respectively through the intermediate transfer member 50. Further, the fixing roll 2 and the belt nip unit 20 are mounted opposite to each other through the intermediate transfer member 50. A heater 9 is disposed around the outer periphery of the intermediate transfer member 50 on a more upstream side than the fixing unit having the fixing roll 2 and the belt nip unit 20, whereas a cooling unit 40 is mounted around the outer periphery of the intermediate transfer member 50 on the downstream side. The intermediate transfer member 50 is tensioned with support rolls 5*a*, 5*b*, 5*c*, 5*d*.

In the image forming apparatus shown in FIG. 2, the four photoreceptors 1*a*, 1*b*, 1*c*, 1*d* mounted on the outer periphery of the intermediate transfer member 50 are uniformly charged with the chargers 10*a*, 10*b*, 10*c*, 10*d* respectively, and then exposed with a light scanning unit (not shown) to form electrostatic latent images. The electrostatic latent images of the photoreceptors are developed with the developing units 11*a*, 11*b*, 11*c*, 11*d* containing black, yellow, magenta and cyan toners, and the respective color toner images are formed on the photoreceptors. The color toner images are transferred onto the intermediate transfer member 50 with the transfer units 12*a*, 12*b*, 12*c*, 12*d*to form the toner image of plural colors on the intermediate transfer member 50.

Subsequently, the toner image formed on the intermediate transfer member 50 is beat-fused with the heater 9. The heat-resistant belt 22 is urged against the fixing roll 2 as a paper (recording medium) 60 is fed. The toner image of plural colors held on the intermediate transfer member 50 is first pressed against the heat-resistant belt 22 with the intermediate transfer member 50 by being held between the intermediate transfer member 50 and the paper 60. The intermediate transfer member 50 and the paper 60 are then pressed more strongly by being moved between the fixing roll 2 and the pressure roll 23, and are heated. And, the intermediate transfer member 50 and the paper 60 transported integrally from the heating zone are cooled with the cooling unit 40. The intermediate transfer member 50 and the paper 60 cooled with the cooling unit 40 are further transported. In the support roll 5*c*, the paper 60 is separated from the intermediate transfer member 50 along with the toner image owing to the stiffness of the paper 60 itself to form the color image made of the toner image fixed on the paper 60.

EXAMPLES

The invention is illustrated specifically by referring to the following Examples and Comparative Examples. However, the invention is not limited thereto at all. In the following description, parts are all on the weight basis unless otherwise instructed. A kneading granulation method is used as a method for forming a toner. However, it is not critical.

Production of Toner Particles A

Polyester Resin (Linear Polyester Obtained by Polycondensation of Terephthalic Acid, Bisphenol A Ethylene Oxide Adduct and Cyclohexane Dimethanol)

| | |
|---|---|
| ($G' = 3 \times 10^3$, Tm = 78° C., Tg = 62° C., Mn = 4,000, Mw = 12,000) | 100 parts |
| Cyan pigment (C. I. Pigment Blue 15:3) | 4 parts |

The components are premixed well with a Henschel mixer, melt-kneaded with a biaxial roll mill, cooled, then finely divided with a jet mill, and further classified twice with an air classifier to produce toner (cyan toner) particles in which the amounts of toner particles having a volume average particle diameter of 6.5 $\mu$gm and a particle diameter of 4 $\mu$m or less are 12% by number and the amounts of toner particles having a particle diameter of 16 $\mu$m or more are 0.5% by volume. A magenta toner, a yellow toner and a black toner are produced in the same manner except that the colorant is changed from the cyan pigment (C.I. Pigment Blue 15:3) to a magenta pigment (C.I. Pigment Red 57:1), a yellow pigment (C.I. Pigment Yellow 17) and carbon black. Thus, four full color toners are obtained. At a temperature at which a loss elastic modulus (G") of the resulting toner reaches $1\times10^4$ Pa, a storage elastic modulus (G') of the toner (hereinafter simply referred to as a "storage elastic modulus (G')") is $3.0\times10^3$ Pa. One hundred parts of the toner particles of each color and 0.6 part of hydrophobic titanium oxide fine particles having a BET specific surface area of 100 $m^2/g$ as an external additive are mixed with a Henschel mixer to produce toner particles A of each color having the storage elastic modulus (G') of $3.0\times10^3$ Pa.

Production of Toner Particles B

Toner particles B of each color having a storage elastic modulus (G) of $7.0\times10^2$ Pa are produced in the same manner as toner particles A except that the properties of the polyester resin are changed to Tm=64° C., Tg=55° C., Mn=2,800 and Mw=15,000 and the volume average particle diameter to 5.8 μm.

Production of Toner Particles C

Toner particles C of each color having a storage elastic modulus (G') of $4.0\times10^2$ Pa are produced in the same manner as toner particles A except that the properties of the polyester resin are changed to Tm=60° C., Tg=48° C., Mn=3,500 and Mw=32,000 and the volume average particle diameter to 6.2 μm.

Production of Toner Particles D

Toner particles D of each color having a storage elastic modulus (G') of $1.5\times10^2$ Pa are produced in the same manner as toner particles A except that the properties of the polyester resin are changed to Tm=62° C., Tg=52° C., Mn=2,600 and Mw=15,000 and the volume average particle diameter to 7.0 μm.

Production of Toner Particles E

Toner particles E of each color having a storage elastic modulus (G') of $8.0\times10^3$ Pa are produced in the same manner as toner particles A except that the properties of the polyester resin are changed to Tm=72° C., Tg=60° C., Mn=8,000 and Mw=150,000 and the volume average particle diameter to 4.8 μm.

Production of Toner Particles F

Toner particles F of each color having a storage elastic modulus (G') of $1.0\times10^2$ Pa are produced in the same manner as toner particles A except that the properties of the polyester resin are changed to Tm=58° C., Tg=40° C., Mn=3,200 and Mw=20,000 and the volume average particle diameter to 5.5 μm.

Production of Toner Particles G

Toner particles F of each color having a storage elastic modulus (G') of $1.0\times10^2$ Pa are produced in the same manner as toner particles A except that the properties of the polyester resin are changed to Tm=64° C., Tg=55° C., Mn=4,000 and Mw=15,000 and the volume average particle diameter to 1.2 μm.

Properties of above-obtained toner particles A to G are shown in TABLE 1.

TABLE 1

| Toner | Storage elastic modulus at a temperature at which to give loss elastic modulus G" = $1 \times 10^4$ | Number average molecular weight: Mn | Weight average molecular weight: Mw | Softening point: Tm (° C.) | Glass transition point: Tg (° C.) | Toner average particle diameter: $D_{50}$ (μm) |
|---|---|---|---|---|---|---|
| A | $3.0 \times 10^3$ | 4000 | 12000 | 78 | 62 | 6.5 |
| B | $7.0 \times 10^2$ | 2800 | 15000 | 64 | 55 | 5.8 |
| C | $4.0 \times 10^2$ | 3500 | 32000 | 60 | 48 | 6.2 |
| D | $1.5 \times 10^2$ | 2600 | 15000 | 62 | 52 | 7.0 |
| E | $8.0 \times 10^3$ | 8000 | 150000 | 72 | 60 | 4.8 |
| F | $1.0 \times 10^2$ | 3200 | 20000 | 58 | 40 | 5.5 |
| G | $1.0 \times 10^2$ | 4000 | 15000 | 64 | 55 | 1.2 |

| Production of a carrier | |
|---|---|
| Ferrite particles (electric resistance $1 \times 10^8$ Ωcm) | 100 parts |
| Toluene | 14 parts |

-continued

| Production of a carrier | |
|---|---|
| Perfluorooctylethyl acrylate/methylmethacrylate copolymer (copolymerization ratio = 40:60, Mw = 50,000) | 1.6 parts |
| Carbon black (VXC-72 made by Cabot) | 0.12 part |
| Crosslinked melamine resin (average particle diameter = 0.3 μm) | 0.3 part |

The components except ferrite particles are dispersed with a stirrer for 10 minutes to prepare a film-forming solution. This film-forming solution and the ferrite particles are charged into a vacuum deaeration-type kneader, and stirred at 60° C. for 30 minutes. Toluene is then distilled off under reduced pressure, and the film is formed on the surfaces of the ferrite particles to obtain a carrier.

Since the carbon black particles and the crosslinked melamine resin particles diluted with toluene are dispersed in the perfluorooctylethyl acrylate/methylmethacrylate copolymer used as the matrix resin in the film with a sand mill, carbon black and crosslinked melamine resin particles are uniformly dispersed in the film of the resulting carrier.

Examples 1 to 4 and Comparative Examples 1 to 5

Eight parts of toner particles A of each color and 92 parts of the carrier are mixed to produce developer A of each color. Developers B to G of each color are produced in the same manner using toner particles B to G of each color. Using the resulting developers of the respective colors, a copying test is conducted with a remodeled machine of Color Docu Tech 60 manufactured by Fuji Xerox Co., Ltd., provided with a fixing unit having a structure shown in FIG. 1.

In this case, a roll 50 mm in outer diameter which is obtained by coating a silicone rubber having a hardness of 50° on a hollow aluminum roll to a thickness of 0.5 mm is used as the fixing roll 2, and a roll 50 mm in outer diameter which is obtained by coating a silicone rubber having a hardness of 50° on a hollow aluminum roll to a thickness of 0.3 mm is used as the pressure roll 23. A nip pressure provided by the fixing roll 2 and the pressure roll 23 is set as shown in TABLE 2 below. A nip width is approximately 6 mm.

A paper J made by Fuji Xerox Co., Ltd. is used as a recording medium.

<Measurement of a Gloss Level>

A gloss level of an image after the copying test is measured with an angle of incident light to a sample being 75° using GM26D manufactured by Murakami Color Research Laboratory. The results of the measurement are shown in TABLE 2 below.

<Evaluation of an Image Quality>

An image quality at the outset of the test and of a 10,000th sheet, a 50,000th sheet and a 100,000th sheet is evaluated. The results of the evaluation are shown in TABLE 2 below.

TABLE 2

| | Toner used | Nip pressure (Pa) | Gloss level | Image quality at the outset of the test | 10,000th sheet | 50,000th sheet | 100,000th sheet |
|---|---|---|---|---|---|---|---|
| Ex. 1 | A | $3.9 \times 10^5$ | 65 | no problem | no problem | no problem | no problem |
| Ex. 2 | B | $3.9 \times 10^5$ | 70 | no problem | no problem | no problem | no problem |
| Ex. 3 | C | $3.9 \times 10^5$ | 78 | no problem | no problem | no problem | no problem |
| Ex. 4 | A | $7.8 \times 10^5$ | 60 | no problem | no problem | no problem | no problem |
| Comp. Ex. 1 | D | $3.9 \times 10^5$ | 40 | *1 | *1, *2 | *1, *2 | *1, *2 |
| Comp. Ex. 2 | E | $3.9 \times 10^5$ | 20 | *3 | *3 | *3 | *3 |
| Comp. Ex. 3 | F | $3.9 \times 10^5$ | 35 | *1 | *1, *2 | *1, *2 | *1, *2 |
| Comp. Ex. 4 | G | $3.9 \times 10^5$ | 42 | *4 | *4 | *4 | *4 |
| Comp. Ex. 5 | D | $7.8 \times 10^5$ | 30 | *1 | *1, *2 | *1, *2 | *1, *2 |

The image quality is evaluated according to the following grades.
*1 Non-uniform melting occurs in a thin line.
*2 Offset occurs on the intermediate transfer member.
*3 Offset occurs on the recording medium.
*4 Fogging occurs on a background area.

From the results in TABLE 2, it is found that in the image forming method of the invention in Examples 1 to 4 using a combination of the fixing unit of the belt nip method specified in the invention and the toner having the specific viscoelasticity characteristics, the high image quality is obtained over a long period of time, the offset is prevented without feeding a release agent and the gloss level of the image can be controlled.

According to the invention, there is provided an image forming method in which even though a release agent is not substantially supplied, neither the image disarray in the image transfer nor the non-uniform melting of the toner occurs and the gloss level of the image can be controlled.

The entire disclosure of Japanese Patent Application No. 2000-318998 filed on Oct. 19, 2000 including specification, claims, drawings and abstract is incorporated herein by reference in its entirety.

What is claimed is:

1. An image forming method, comprising:

transferring a toner image formed on an image bearing member onto an intermediate transfer member; and simultaneously transferring and fixing the toner image on the intermediate transfer member onto a recording medium using a transfer and fixing unit, wherein:

the toner forming the toner image contains a binder resin and a colorant, and the toner has a storage elastic modulus (G') of $2\times10^2$ to $6\times10^3$ Pa at a temperature at which a loss elastic modulus (G") of the toner reaches $1\times10^4$ Pa, the transfer and fixing unit has a nip between a fixing roll coated with an elastic member and a heat-resistant belt laid across in a tensioned condition with a plurality of support rolls of a belt nip unit, and the heat-resistant belt is urged against the fixing roll by a pressure roll and the elastic member of the fixing roll is twisted at an exit of a nip with the pressure roll mounted inside the heat-resistant belt through the heat-resistant belt, and a gloss level of the image is controlled by changing a pressure of the pressure roll.

2. The image forming method as claimed in claim 1, wherein a number average molecular weight (Mn) of binder resin of the toner is in the range of 2,500 to 20,000.

3. The image forming method as claimed in claim 1, wherein a weight average molecular weight (Mw) of the binder resin of the toner is in the range of 9,000 and 90,000, and a softening point (Tm) thereof is in the range of 60° C. to 120° C.

4. The image forming method as claimed in claim 1, wherein a glass transition point (Tg) of the binder resin of the toner is in the range of 45° C. to 70° C.

5. The image forming method as claimed in claim 1, wherein the toner has the storage elastic modulus (G') of about $6\times10^2$ Pa to about $4\times10^3$ Pa at the temperature at which the loss elastic modulus (G") of the toner reaches $1\times10^4$ Pa.

6. The image forming method as claimed in claim 1, wherein a volume average particle diameter ($D_{50}$) of the toner is in the range of 2 $\mu$m to 9 $\mu$m.

7. The image forming method as claimed in claim 1, wherein the toner has an inorganic oxide fine particles as an external additive, and a BET specific surface area of the inorganic oxide fine particles is in the range of 40 $m^2/g$ to 250 $m^2/g$.

8. The image forming method as claimed in claim 7, wherein the inorganic oxide fine particles are selected from silica and titanium oxide.

9. The image forming method as claimed in claim 1, wherein each of the fixing roll and the pressure roll comprises a metal core and a heat-resistant elastic layer.

10. The image forming method as claimed in claim 9, wherein the heat-resistant elastic layer of at least one of the fixing roll and the pressure roll contains a component selected from a silicone rubber, a fluororubber, a fluorine latex and a fluororesin.

11. The image forming method as claimed in claim 1, wherein the toner image on the recording medium after the simultaneous transfer and fixing has a gloss level of 10 to 80.

12. An image forming apparatus, comprising:

a transfer unit that transfers a toner image formed on an image bearing member onto an intermediate transfer member; and a simultaneous transfer and fixing unit that transfers and fixes the toner image on the intermediate transfer member onto a recording medium, wherein the toner forming the toner image contains a binder resin and a colorant, and the toner has a storage elastic modulus (G') of $2\times10^2$ Pa to $6\times10^3$ Pa at a temperature at which a loss elastic modulus (G") of the toner reaches $1\times10^4$ Pa, the transfer and fixing unit has a nip between a fixing roll coated with an elastic member and a heat-resistant belt laid across in a tensioned condition with a plurality of support rolls of a belt nip unit, and the heat-resistant belt is urged against the fixing roll by a pressure roll and the elastic member of the fixing roll is twisted at an exit of a nip with the pressure roll mounted inside the heat-resistant belt through the heat-resistant belt, and a gloss level of the image is controlled by changing a pressure of the pressure roll.

13. The image forming apparatus as claimed in claim 12, wherein each of the fixing roll and the pressure roll comprises a metal core and a heat-resistant elastic layer.

14. The image forming apparatus as claimed in claim 13, wherein the heat-resistant elastic layer of at least one of the fixing roll and the pressure roll contains a component selected from a silicone rubber, a fluororubber, a fluorine latex and a fluororesin.

15. The image forming apparatus as claimed in claim 12, wherein a number average molecular weight (Mn) of the binder resin of the toner is in the range of 2,500 to 20,000.

16. The image forming apparatus as claimed in claim 12, wherein a weight average molecular weight (Mw) of the binder resin of the toner is in the range of 9,000 and 90,000, and a softening point (Tm) thereof is in the range of 60° C. to 120° C.

17. The image forming apparatus as claimed in claim 12, wherein the toner has the storage elastic modulus (G') of about $6\times10^2$ Pa to about $4\times10^3$ Pa at the temperature at which the loss elastic modulus (G") of the toner reaches $1\times10^4$ Pa.

* * * * *